US011319698B2

(12) United States Patent
Coy

(10) Patent No.: US 11,319,698 B2
(45) **Date of Patent: *May 3, 2022**

(54) SHOWER DRAIN WITH A CLAMPING COLLAR

(71) Applicant: Carl D Coy, Silverthorne, CO (US)

(72) Inventor: Carl D Coy, Silverthorne, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/344,178

(22) Filed: Jun. 10, 2021

(65) Prior Publication Data

US 2021/0293010 A1 Sep. 23, 2021

Related U.S. Application Data

(63) Continuation of application No. 16/530,592, filed on Aug. 2, 2019, now Pat. No. 11,072,916.

(60) Provisional application No. 62/720,503, filed on Aug. 21, 2018.

(51) Int. Cl.
*E03C 1/22* (2006.01)

(52) U.S. Cl.
CPC ..... *E03C 1/22* (2013.01)

(58) Field of Classification Search
CPC ..... E03C 1/22
USPC ... 4/378, 584, 613, 650, 668, 671, 680, 654; 137/247.41, 362, 577; 285/134.1
See application file for complete search history.

(56) References Cited

U.S. PATENT DOCUMENTS

| | | | | |
|---|---|---|---|---|
| 5,944,985 | A * | 8/1999 | Bowman | E03C 1/12 285/125.1 |
| 6,193,879 | B1 * | 2/2001 | Bowman | E03C 1/12 285/125.1 |
| 6,651,272 | B2 * | 11/2003 | Bowman | B01D 61/10 285/132.1 |
| 7,992,233 | B1 * | 8/2011 | Goettl | E04H 4/1236 4/507 |
| 10,724,224 | B2 * | 7/2020 | Deurloo | B01D 29/27 |
| 10,786,765 | B2 * | 9/2020 | DiLalla | B01D 29/27 |
| 11,072,916 | B2 * | 7/2021 | Coy | E03C 1/22 |
| 2003/0024568 | A1 * | 2/2003 | Bowman | B01D 61/10 137/217 |
| 2003/0041389 | A1 * | 3/2003 | Cheo | D06F 37/269 68/17 R |
| 2007/0204977 | A1 * | 9/2007 | Beamer | F28D 1/05366 165/124 |
| 2008/0098506 | A1 * | 5/2008 | Mjelde | E04H 4/1218 4/507 |
| 2008/0272038 | A1 * | 11/2008 | Stetson | E02D 29/14 29/890.141 |
| 2010/0313347 | A1 * | 12/2010 | Shieh | E03D 1/35 4/394 |

(Continued)

*Primary Examiner* — Lori L Baker
(74) *Attorney, Agent, or Firm* — Lyendecker & Lemire

(57) ABSTRACT

Embodiments of a drain comprise three primary components that can be provided in a preassembled configuration: a drain body, which includes an integral upper flange; a lower clamping collar that forms a lower flange; and a waterproof membrane that is fixedly sandwiched between the upper and lower flanges and extends outwardly therefrom. The drain is further characterized through the use of a plurality of fins that extend into the cylindrical interior of the drain body's throat and act to position and hold a drain cover assembly in place replacing the use of threads that are common in the prior art.

17 Claims, 16 Drawing Sheets

(56) References Cited

U.S. PATENT DOCUMENTS

| | | | | |
|---|---|---|---|---|
| 2013/0117924 | A1* | 5/2013 | Barnett | E04H 4/14 4/504 |
| 2013/0193057 | A1* | 8/2013 | Honermann | B01D 29/232 210/442 |
| 2014/0310862 | A1* | 10/2014 | Joseph | E03C 1/262 4/287 |
| 2015/0368891 | A1* | 12/2015 | Miller | E03D 11/16 4/252.1 |
| 2016/0053472 | A1* | 2/2016 | Rosko | E03C 1/2302 4/292 |
| 2016/0184735 | A1* | 6/2016 | Wardle | B01J 14/005 210/219 |
| 2016/0221050 | A1* | 8/2016 | Beck | E03C 1/302 |
| 2016/0271533 | A1* | 9/2016 | Honermann | B01D 35/153 |
| 2017/0260724 | A1* | 9/2017 | Beck | A47K 1/14 |
| 2018/0066420 | A1* | 3/2018 | Beck | B25G 3/28 |
| 2018/0171610 | A1* | 6/2018 | Ahuja | E03C 1/2302 |
| 2019/0226193 | A1* | 7/2019 | Deurloo | B01D 29/27 |
| 2019/0376270 | A1* | 12/2019 | VandenHeuvel | F24H 9/16 |

* cited by examiner

SHOWER DRAIN WITH A CLAMPING COLLAR

RELATED REFERENCES

This application claims priority to and incorporates by reference U.S. Provisional Patent Application 62/720,503 entitled "Easily Installed Pre-Assembled Point Drain with Waterproof Membrane and Non-threaded throat for Securing a Drain Cover" filed on Aug. 21, 2018, which has the same inventor as the present application.

BACKGROUND

Shower drains can be time consuming to install and if not done properly can result in leaks that can damage the floor and ceiling beneath it.

In a typical shower stall having single point drainage, the shower drain comprises three primary components: a primary drain body that couples to the drain pipe and includes a raised lower flange; a locking flange that sandwiches a membrane between it and the lower flange body; and a height adjustable drain cover assembly.

In a typical installation, the body is installed first and connected to the drain pipe through a hole in the subfloor. The drain body is secured to the subfloor wherein the top surface of the lower flange typically rests above the subfloor a predetermined distance to accommodate the thickness of the shower pan. Next, the shower pan is installed which can comprise a plurality of pre-sloped panels that terminate at the edges of the lower flange and are generally flush with it. If the panels or dry set pan is not waterproof, a membrane may be bonded to the pan as well as over the drain's lower flange. If the pan is waterproof a section of membrane can be placed over the drain that overlaps the pan. The membrane is then sandwiched between the lower flange and the locking flange. Finally, a height adjustable drain cover is threadably installed at a cover surface height above the locking flange that takes into account the thickness of the finish flooring, such that the drain cover will rest flush or slightly lower than the surface of the surrounding finish flooring when the stall is complete.

As can be appreciated, if the membrane is not properly secured between the lower flange and the locking flange, such as might be caused by a fold or crease in the material a potentially costly leak can result. Further, just the act of trimming the membrane around the opening including cutting holes for a plurality of affixing fasteners can add a substantial amount of time to the installation process.

In other instances, and installer may want to use a different drain cover assembly than is supplied with the lower pieces. However, this is often not possible. Even though the threading in the drain body or locking flange can be similar between drains of similar size among different manufacturers, in practice the actual sizes, because of differing manufacturing tolerances and standards, may be sufficiently different to prevent the drain cover from one manufacturer being used with the threaded locking flange or body of another manufacturer.

DETAILED DESCRIPTION

Figure 1:
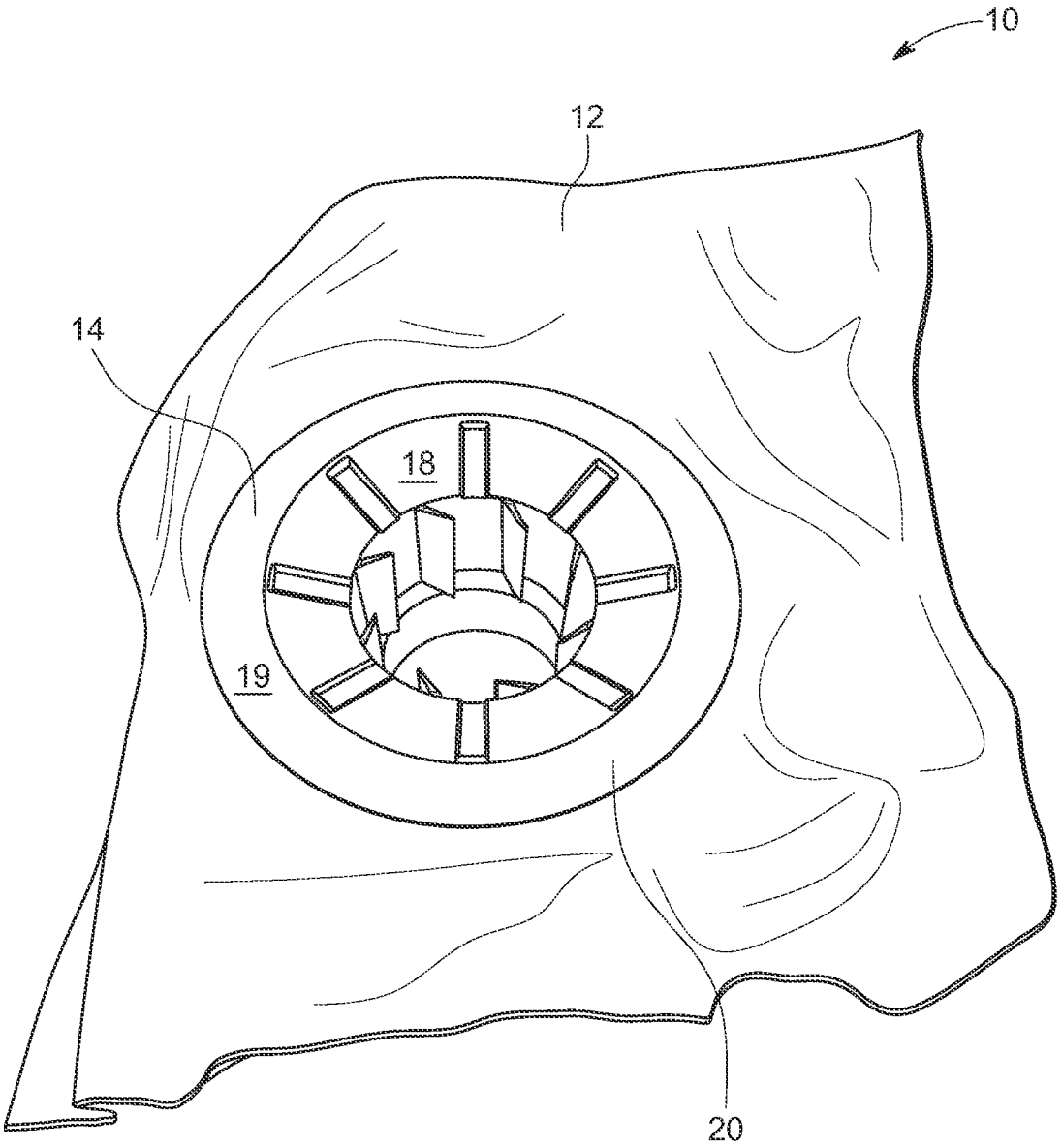
FIG. 1 is an isometric top view of a point shower drain according to an embodiment of the present invention.

A point drain is described that incorporates one or more novel features in various embodiments thereof. In at least one embodiment, the drain comprises three primary components that are typically provided in a preassembled configuration: a drain body, which includes an integral upper flange; a lower clamping collar that forms a lower flange; and a waterproof membrane that is fixedly sandwiched between the upper and lower flanges and extends outwardly therefrom.

Some embodiments of the drain body are characterized by a lower tubular section and an upper flange section. The flange section, which comprises the top surface of the point drain, serves to sandwich the flexible membrane between its bottom surface and the opposing top surface of the clamping collar. Further, the top surface of which a portion is canted inwardly and includes weep channels helps direct water that has seeped through the tiles or other surface material of a shower stall to drain. The cylindrical outside surface of the lower tubular section is typically sized to be received and secured to the interior of a drain pipe. The cylindrical interior or throat of the tubular section comprises a plurality of spaced generally vertically-orientated fins that also extend inwardly into the throat often at an acute angle relative to radial. The fins, which exhibit a degree of flexibility, effectively replace the threaded throat found in substantially all prior art point drain bodies. Advantageously, the flexibility of the fins grip and secure a drain cover assembly but also allow for the receipt therein of drain cover assemblies that vary slightly in diameter. The unthreaded nature of the receiving fins permits greater flexibility in terms of the installation of the drain cover assembly as is discussed in detail below.

The clamping collar which also comprises the lower flange is positioned below the flange section. The exterior shape of the collar can vary, although for the embodiments illustrated herein the collar is substantially square. The thickness of the collar can vary as well such that when installed the top surface of the collar is essentially or near level with the surrounding shower pan at the interface therewith. The collar is typically fused to the body fixedly securing the membrane in place.

The use of securing fins to receive and hold a drain cover assembly in place permits the use of various types of drain cover assemblies that were not possible using prior threaded throat point drains. Additionally, because the drain cover assembly can be raised and lowered without rotating the cover assembly, the height of the drain cover assembly relative to abutting finish flooring, such as tile, can be adjusted after the finish tiles have been placed in circumstances when the shape of the cover portion of the assembly is other than circular. As can be appreciated, this makes it possible to practically use the point drain in conjunction with rectangular-shaped drain covers including linearly-extending drain covers and cover assemblies that make use of square or rectangular tile covers.

Terminology

The terms and phrases as indicated in quotation marks (" ") in this section are intended to have the meaning ascribed to them in this Terminology section applied to them throughout this document, including in the claims, unless clearly indicated otherwise in context. Further, as applicable, the stated definitions are to apply, regardless of the word or phrase's case, to the singular and plural variations of the defined word or phrase.

The term "or" as used in this specification and the appended claims is not meant to be exclusive; rather the term is inclusive, meaning either or both.

References in the specification to "one embodiment", "an embodiment", "another embodiment", "a preferred embodiment", "an alternative embodiment", "one variation", "a variation" and similar phrases mean that a particular feature, structure, or characteristic described in connection with the embodiment or variation, is included in at least an embodiment or variation of the invention. The phrase "in one embodiment", "in one variation" or similar phrases, as used in various places in the specification, are not necessarily meant to refer to the same embodiment or the same variation.

The term "couple" or "coupled" as used in this specification and appended claims refers to an indirect or direct physical connection between the identified elements, components, or objects. Often the manner of the coupling will be related specifically to the manner in which the two coupled elements interact.

The term "directly coupled" or "coupled directly," as used in this specification and appended claims, refers to a physical connection between identified elements, components, or objects, in which no other element, component, or object resides between those identified as being directly coupled.

The terms "approximately" and "substantially" as used in this specification and appended claims, refers to plus or minus 10% of the value given.

The terms "about" and "generally" as used in this specification and appended claims, refers to plus or minus 20% of the value given.

Directional and/or relationary terms such as, but not limited to, left, right, nadir, apex, top, bottom, vertical, horizontal, back, front and lateral are relative to each other and are dependent on the specific orientation of a applicable element or article, and are used accordingly to aid in the description of the various embodiments and are not necessarily intended to be construed as limiting.

An Embodiment of a Point Drain

FIGS. 1-5 illustrate an embodiment of a preassembled point drain 10. The point drain comprises three primary components: a drain body 14; a clamping collar 16 and a waterproof membrane 12 sandwiched between the drain body and the collar.

Figure 2:
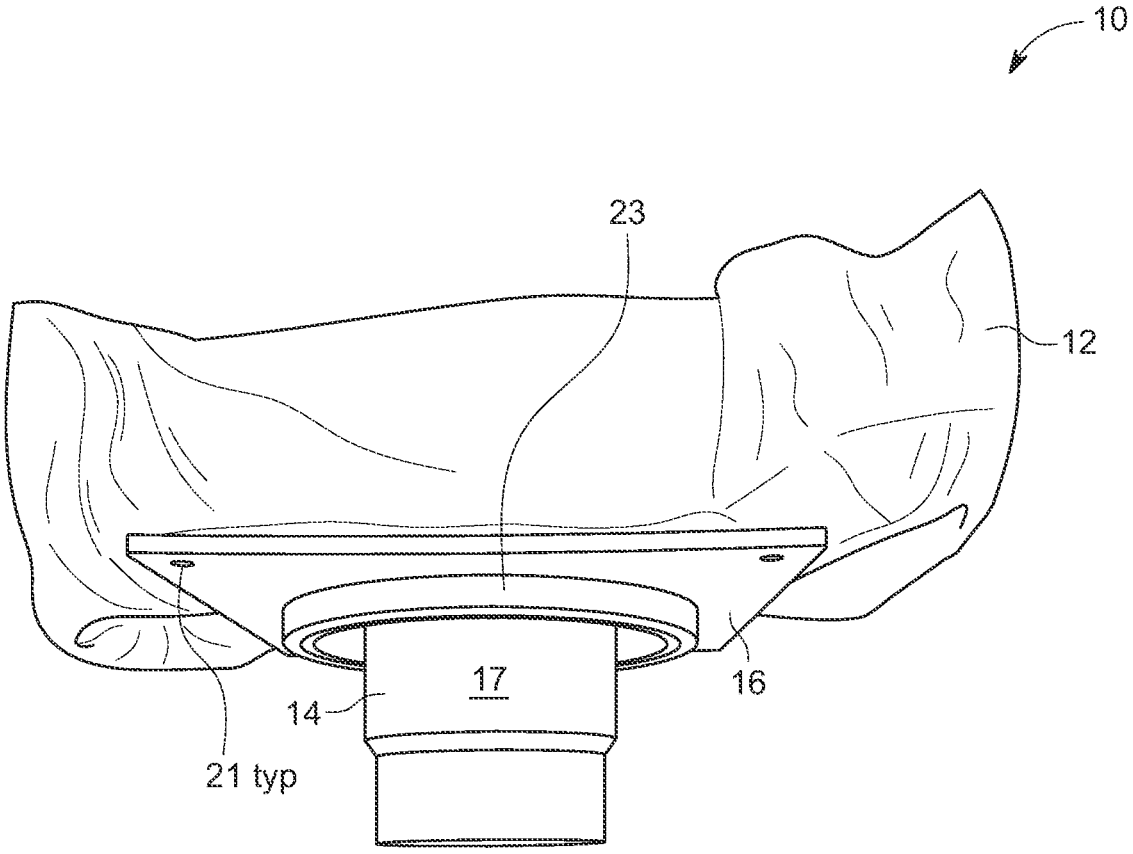
FIG. 2 is an isometric side view of the point shower drain according to the embodiment of the present invention.

The drain body 14 comprises a cylindrical tubular section 17 having open top and bottom drain body ends joined by an interior wall to define an interior (or throat) of the drain body through which water can drain from a shower stall to a drain pipe to which the drain body is attached. To facilitate attachment to a drain pipe a lower outside portion of the tubular section is also cylindrical and has diameters sized to receive a drain pipe over it permitting it to be joined through solvent welding or an adhesive to the inside diameter of the drain pipe. With reference to FIG. 2, the cylindrical tubular section has both a lower outside diameter and an upper outside diameter that is larger than the lower outside diameter with corresponding upper and lower inside diameters. In the illustrated embodiment, the upper diameter is nominally 3" to receive a 3" PVC pipe there over; whereas the lower inside diameter is sized to receive a 2" PVC or ABS pipe therein. Accordingly, this embodiment can be used with both size drain pipes.

Of significant note, the throat of the drain body includes a plurality of longitudinally-extending fins 24 that are generally parallel to the rotational (or longitudinal) axis of the tubular section. The fins are spaced about the circumference of the interior wall with each fin intersecting with the interior wall along a line of intersection. While eight fins are shown in the illustrated embodiments, variations with more or less fins are known.

Each fin 24 is generally rectangular having an outside edge along its line of intersection with the interior wall of the cylindrical tubular section 17 and an opposing generally parallel inside edge terminating in the throat. As shown, each fin extends inwardly from the interior wall at an acute angle relative to a hypothetical plane formed by the fin's line of intersection and the rotational axis. In some variations the angle can vary anywhere from 0-90 degrees with the angle typically being between 30-60 degrees. As shown most clearly in FIG. 5, each fin is thickest at its intersection with the interior wall and tapers outwardly to its inside edge. In this regard, the ends of the fins are more flexible and compliant.

Figure 7:
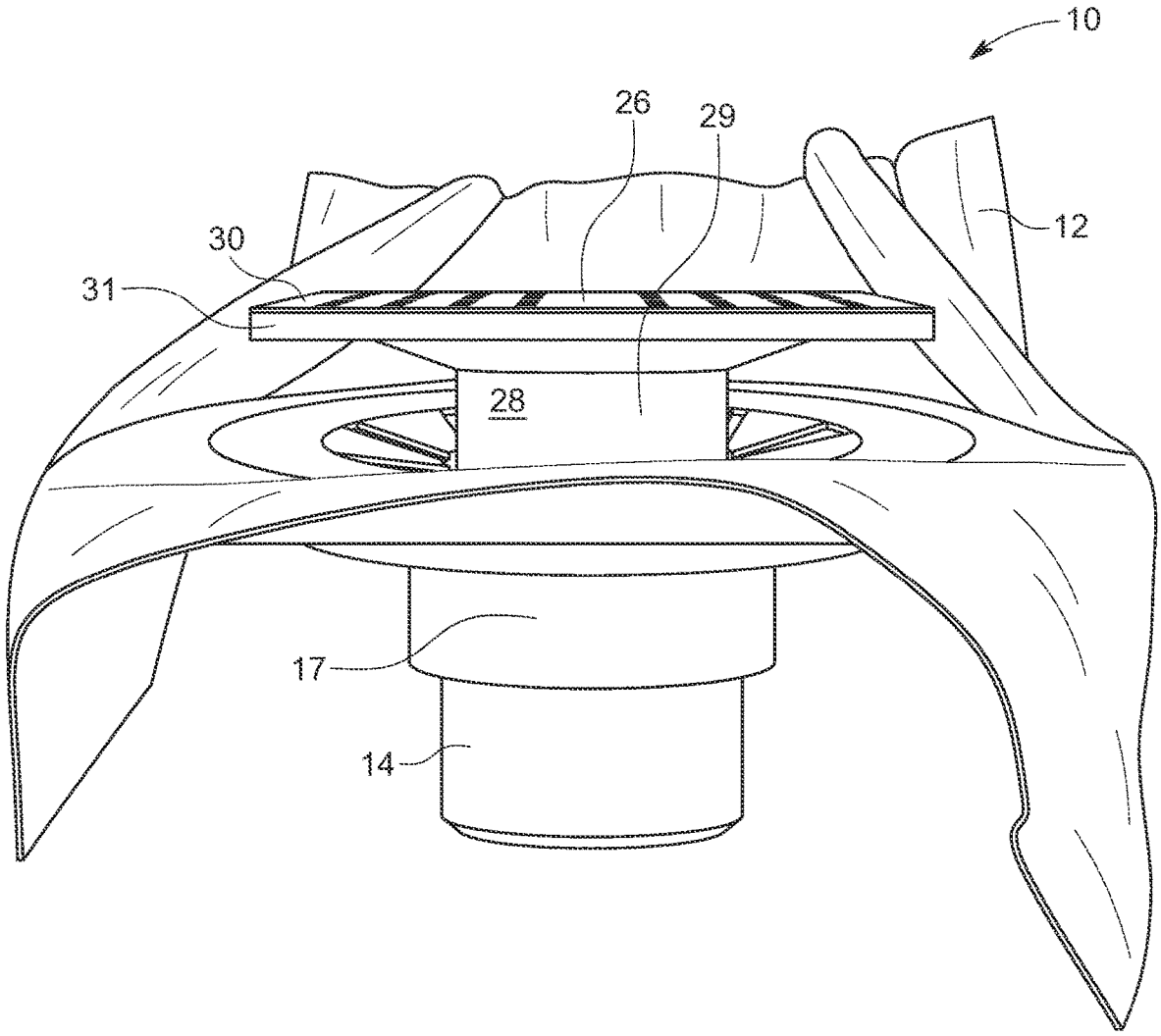
FIG. 7 is an isometric side view of the point shower drain with the drain cover assembly of FIG. 6 installed therein according to an embodiment of the present invention.

The fins 24 replace a threaded throat of prior art point drains and through their resilience act in concert to hold the body of a drain cover assembly 26 at a desired height as is described in greater detail below and is shown in FIG. 7.

The illustrated drain body 14 also comprises a flange section 19 integral with the tubular section's top end. The flange section also extends outwardly from the top end comprising an interior portion 18 circumscribing the top end opening and an exterior portion 20 circumscribing the interior portion. The interior portion is generally concave sloping downwardly towards the intersection with the top end opening. A plurality of radially-extending weep channels 22 (referred to as "22 typ" in the figures) are distributed around the interior portion for funneling water towards the top end opening. The exterior portion is generally relatively thin and includes substantially flat flange top and bottom sides.

The drain body 14 can be comprised of any suitable material but is most typically comprised of an injection molded plastic. In at least some embodiments, the drain body is comprised of either ABS or PVC plastic to permit them to be solvent welded to drain pipe of the same construction.

Figure 3:
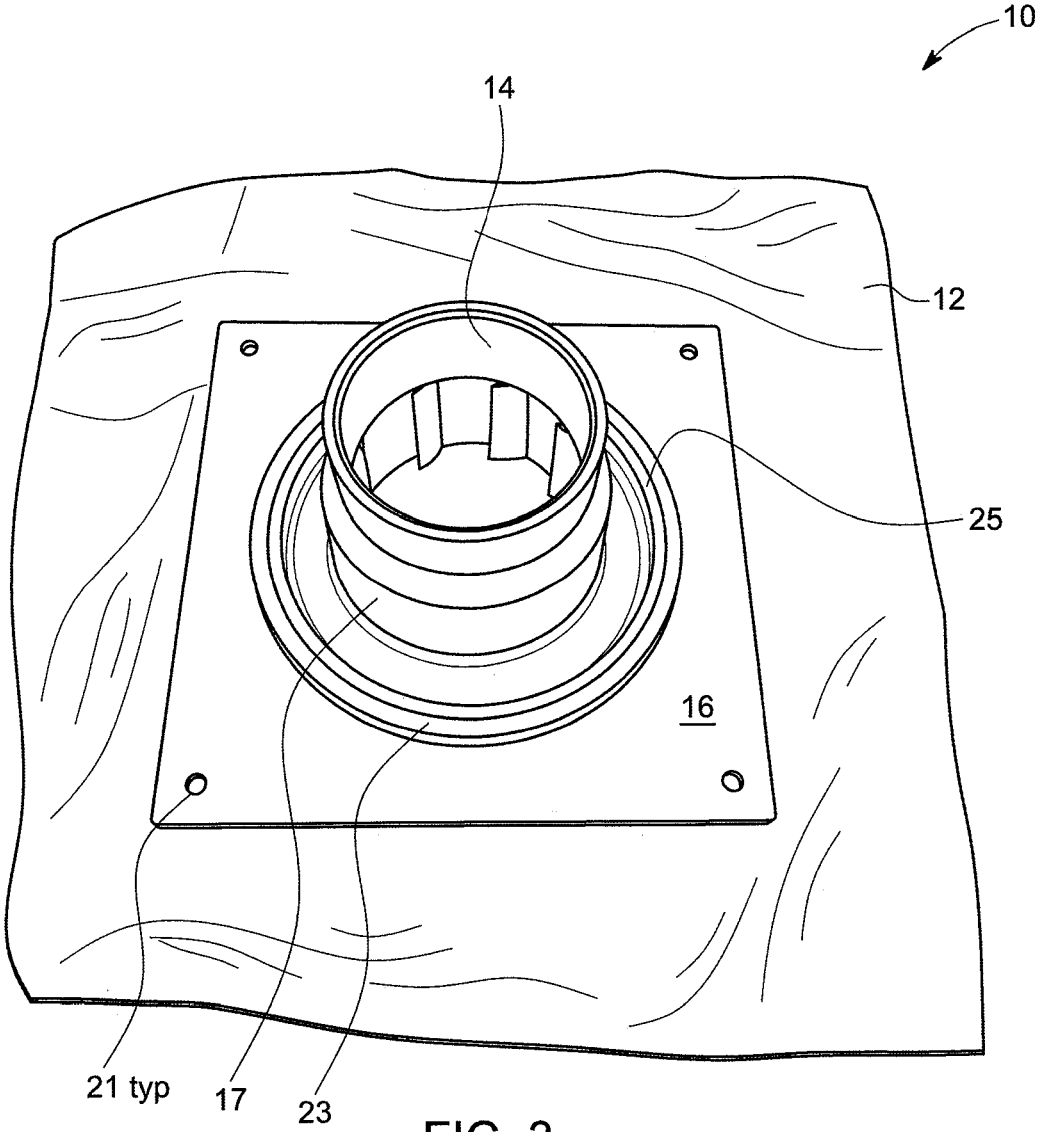
FIG. 3 is an isometric bottom view of the point shower drain according to the embodiment of the present invention.
Figure 4:
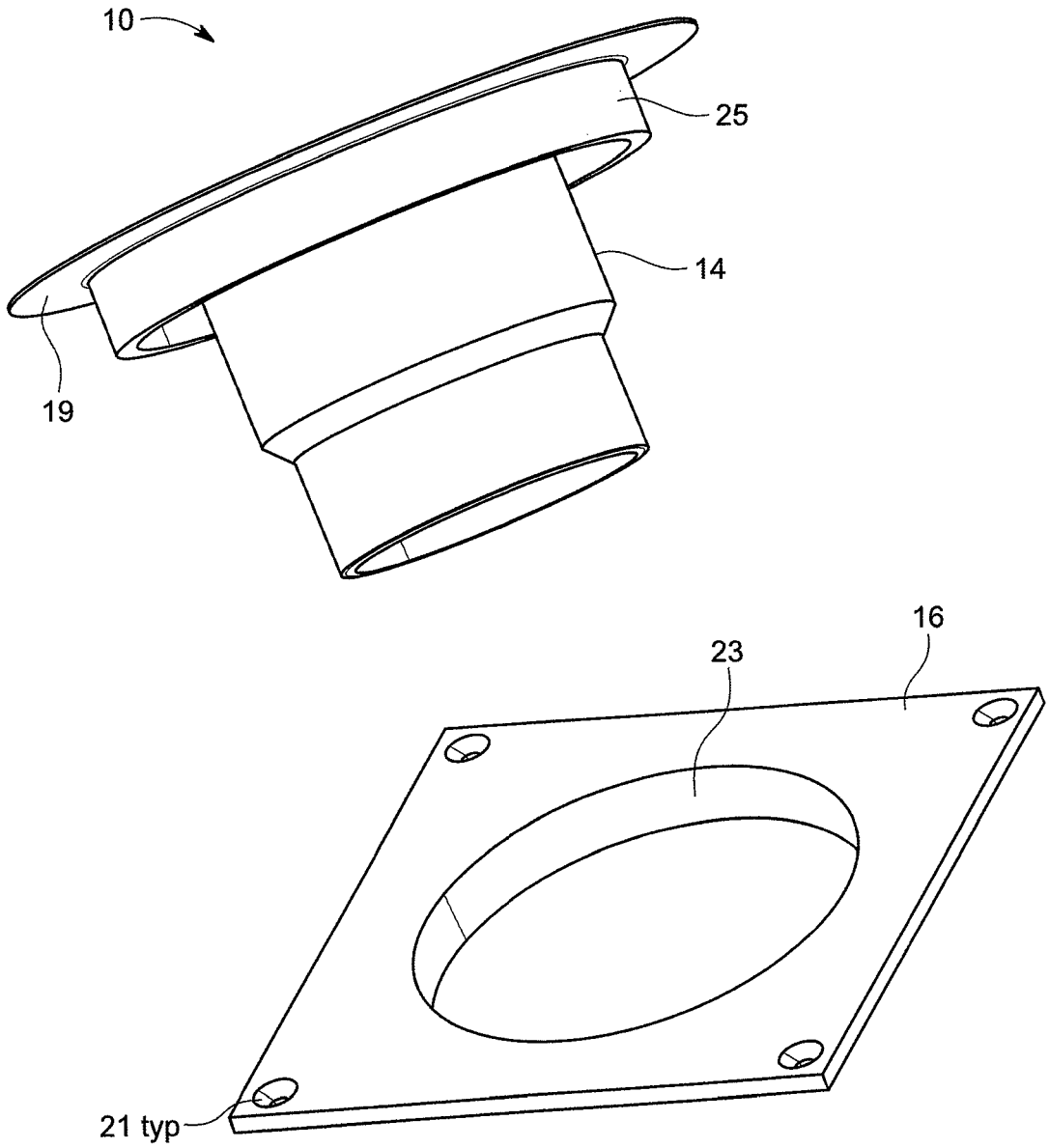
FIG. 4 is an isometric exploded view of the drain body and clamping collar of the point shower drain according to the embodiment of the present invention.
Figure 5:
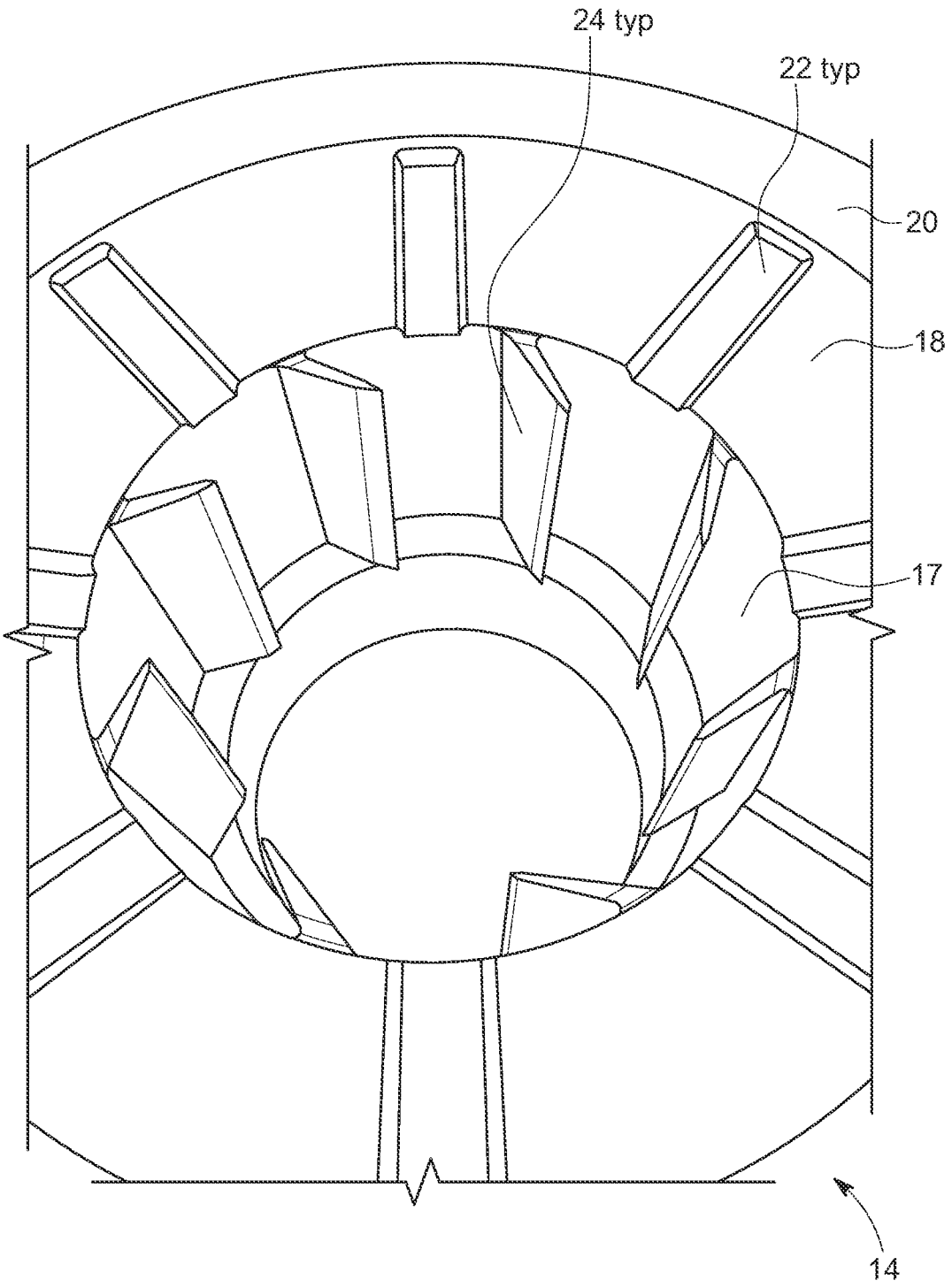
FIG. 5 is a partial isometric top view of the drain body illustrating the securing fins according to the embodiment of the present invention.

The clamping collar 16 is best seen in FIGS. 2, 3 & 4. It is typically made of the same type of plastic as the drain body to facilitate the joining of the two pieces together by way of solvent bonding, although variations made of other materials are contemplated. The collar can have any suitable shape but is shown in the illustrated embodiment as being substantially rectangular or square. The square shape permits an installer to easily use sloped preformed boards to form the shower pan without having to form an arcuate edge to conform to a round point drain. The collar thickness can vary but is typically such that the top of the point drain is essentially flush or slightly lower than the top surface of the surrounding shower pan when installed.

The collar 16 has a substantially flat collar upper side and a substantially flat collar bottom side save for a downwardly extending collar circumferential ridge 23 that circumscribes a open collar center. The collar circumferential ridge is configured to mate with a corresponding body circumferential ridge 25 that extends downwardly from the bottom side flange section at the proximate intersection of the internal and exterior portions thereof. The two ridges are one or more of interference fit, solvent welded and adhesively bonded to secure the clamping collar in place and sandwich the waterproof membrane 12 as will be described below.

As illustrated, the clamping collar 16 also includes a plurality of fastener holes 21 (also referred to as "21 typ" in the figures) which are typically used in conjunction with threaded fasteners to secure the drain to a subfloor. Four fastener holes are illustrated but other variations with more or less holes are known.

The third primary component of the point drain comprises the waterproof membrane 12. The flexible thin membrane can be mad of any suitable material and essentially serves to waterproof the intersection of the point drain and the surrounding shower pan. The membrane as shown is essentially square with a circular center opening. One variation comprises a thin sheet of water impervious elastomeric material that has a non-woven fiber layer adhered to both its top and bottom side. The non-woven fibers increase the adhesiveness of the membrane so that it can be bonded to the shower pan, and so that grout and/or mastic used to secure finish tiles to the shower floor stick to the membrane.

In constructing the point drain 10, the membrane 12 is placed between the flat bottom side of the exterior portion of the flange section 19 and the flat upper side of the clamping collar 16. The drain body 14 and clamping collar are then secured together clamping the membrane in place and forming a substantially water tight seal between the drain body and the clamping collar. In some variations, the surface of the membrane to be sandwiched can be coated with an adhesive to further facilitate the creation of a water tight seal.

Embodiments of Drain Cover Assemblies

The configuration of embodiments of the point drain 10 and in particular the use of longitudinally-extending fins 24 (also referred to as "24 typ" in the figures) instead of threads in the throat of the drain body 14 to secure a drain cover assembly in place permits the use of the embodiments with a wide variety of different drain cover assemblies. For instance, drain cover assemblies of different manufactures can be used with the point drain as long as the diameter of the cylindrical portion of a drain cover body is nominally the same as that of the associated point drain embodiment. This is true regardless of small variations in manufacturing tolerances and the particular thread configuration provided on the third party drain cover body.

Further, because the drain cover assembly need not be threaded in place but rather can be pushed downwardly into position, greater flexibility is provided in installing the drain cover body and assembly compared to many prior art point drains. For instance, embodiments of linear drain cover assemblies can be position in the point drain 10 even when the drain is located close to a shower stall wall; whereas, this would likely not be possible with a similar threaded cover because the wall would prevent the cover assembly from being rotated to thread it in place. Additionally, square covers, such as the one illustrated in FIG. 6 can be installed and cemented in place after the finish tile has been installed. This would not be possible with a screw in drain cover assembly since the edges of the adjacent tiles would prevent the last couple rotations.

Figure 6:
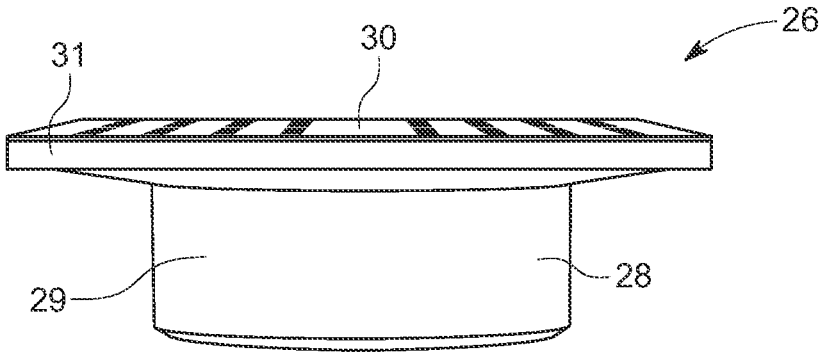
FIG. 6 is an isometric side view of a drain cover assembly as can be utilized with the first embodiment point drain according to an embodiment of the present invention.

A first embodiment drain cover assembly 26 is illustrated in FIGS. 6 & 7. It comprises a drain cover body 28, and a drain cover 30. The body comprises a cylindrical portion 29 including a tubular passage extending from an open top end to an open bottom end. As shown the cylindrical portion has a smooth exterior wall different from prior art drain cover bodies, which are threaded. The cylindrical portion is configured for receipt into the throat or tubular section 17 of the drain body 14 with the plurality of fins 24 acting to hold the drain cover body in place within the drain body as shown in FIG. 7.

The top portion 31 of the drain cover body 28 flares outwardly and as shown comprises a rectangular/square shape. The flared top portion can be of other shapes and sizes depending on the intended use thereof. For instance, circular flared top portions are known. A drain cover member 30 is typically received over the flared top portion. It can be held in place by any suitable means but is often attached to the flared top portion by way of threaded fasteners. The drain cover member can be comprised of any suitable material but sheet stainless steel is typical.

Figure 8:
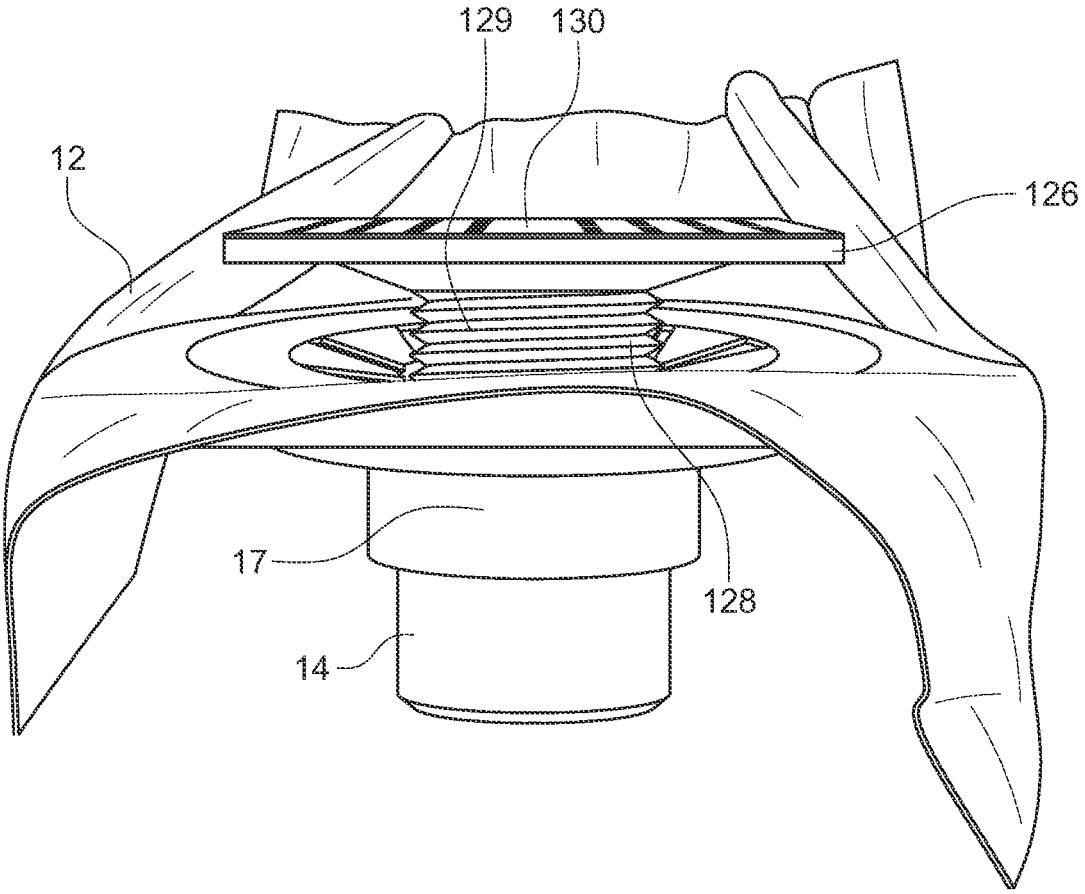
FIG. 8 is an isometric side view of the point shower drain with a prior art drain cover assembly installed therein according to an embodiment of the present invention.

FIG. 8 is an illustration of an embodiment of the point drain 10 in combination with a prior art threaded drain cover assembly 126 received therein. Of note the cylindrical portion 129 of the prior art drain cover body 128 is threaded. Nevertheless, it can be received in the throat of an embodiment of the point drain. As shown the prior art assembly also includes a drain cover member 130.

Figure 9:
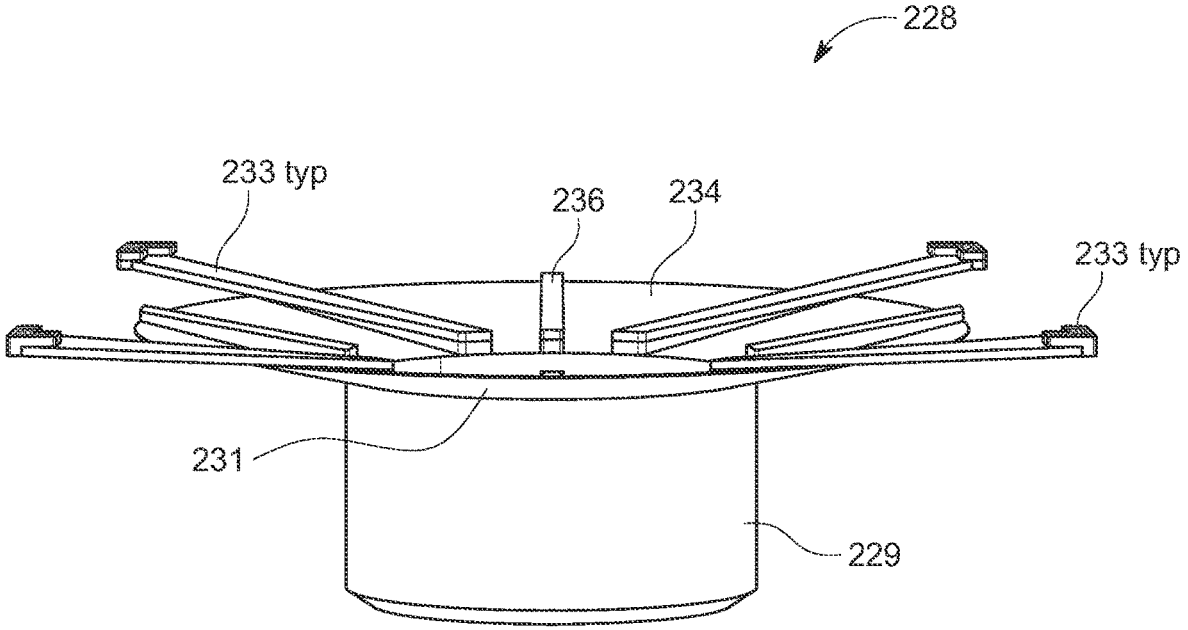
FIG. 9 is an isometric side view of a drain cover body configured to receive a tile thereon according to an embodiment of the present invention.
Figure 10:
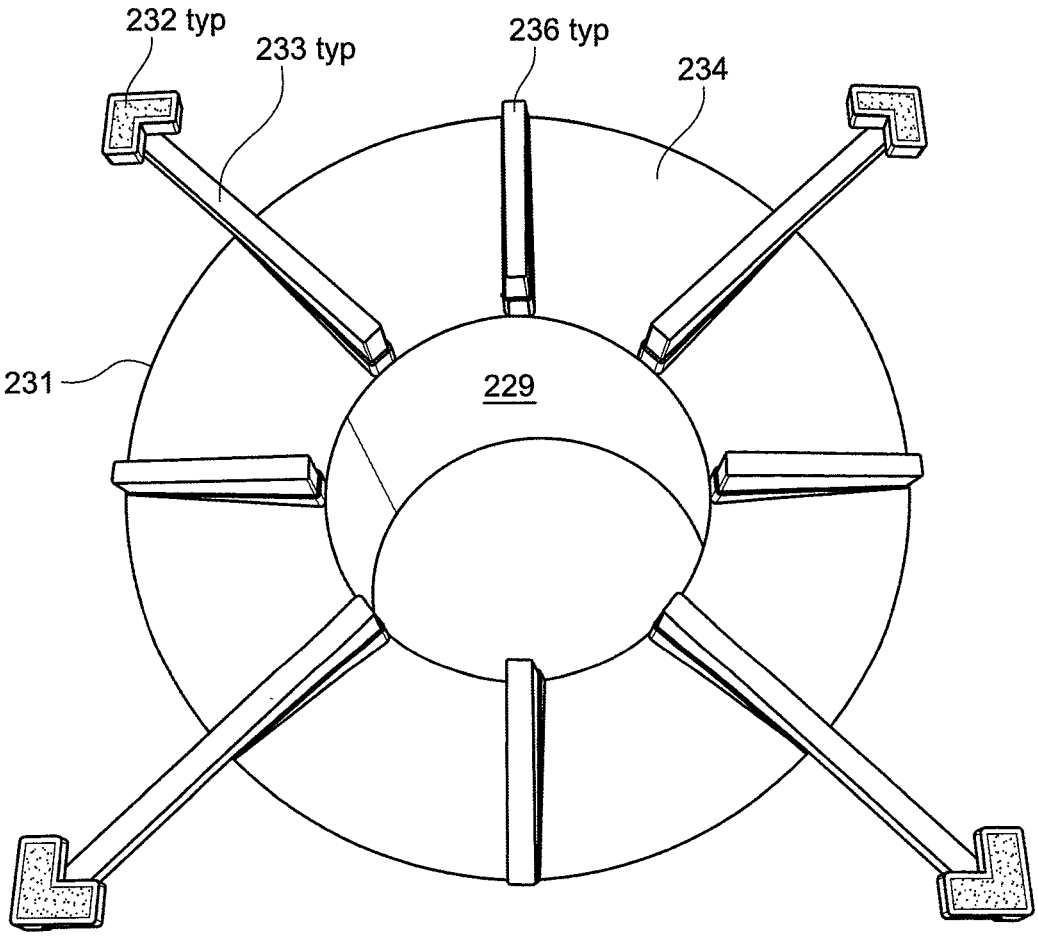
FIG. 10 is an isometric top view of the drain cover body of FIG. 9 according to the embodiment of the present invention.
Figure 11:
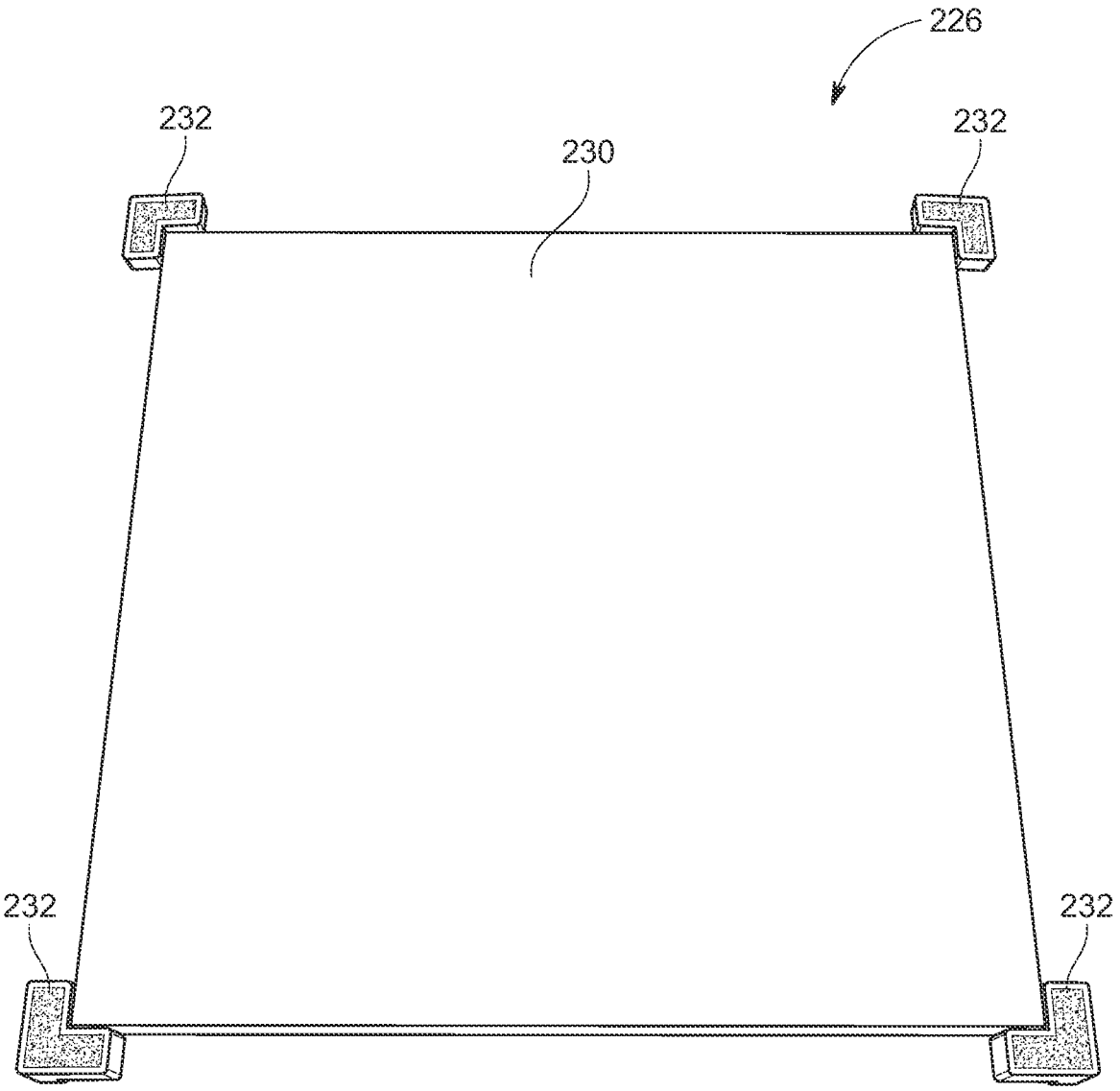
FIG. 11 is an isometric top view of the drain cover body of FIG. 9 with a tile set thereon according to the embodiment of the present invention.

FIGS. 9-11 illustrate another embodiment of a tile receiving drain cover assembly 226. The cylindrical portion 229 of this drain cover body 228 is substantially similar to that of the embodiment described above with reference to FIG. 6. However, the flared top portion 231 is substantially different being configured to removably cradle a ceramic or similar tile 230 while allowing drain water to flow into the point drain and into the tubular passage of the drain cover body 14 from the edges of the tile. Essentially, the use of this particular cover assembly 226 causes the drain to blend in with the finish tile flooring of an associated shower stall wherein one of the only indications of the drain's location is the lack of finish grout surrounding the drain cover tile.

FIGS. 9 and 10 illustrate the flared tile cradle portion 231 in detail. It comprises a concave/conical section 234 that extends outwardly and upwardly from the open top end of the cylindrical portion. Four tile corner support arms 233 (also referred to as "233 typ" in the figures) extend upwardly from the conical section and outwardly from the edge of the conical section. The top surface of each support arm is substantially flat and coplanar with the top surfaces of the other arms. Each arm is located orthogonally relative to adjacent support arms. Each arm further includes a tile corner stop 232 (also referred to as "232 typ" in the figures) at its distal end that rises upwardly from the top surface. The tile corner stop includes a inwardly-facing v-shaped notch that acts to fit around the corner of an associated cover tile 230.

The tile cradle portion also includes four tile supports 236 (also referred to as "236 typ" in the figures) with a support being positioned between adjacent support arms 233. Each tile support rises upwardly from the conical section 234 and includes a flat top surface that is coplanar with the top surfaces of the other supports as well as the top surfaces of the support arms. The supports act to further support the cover tile 230.

FIG. 11 is an illustration of the tile receiving drain cover assembly 226 with a tile 230 received on the tile cradle portion. A variation of the tile receiving drain cover assembly includes a thin stainless steel plate that can be received into the tile cradle portion. A mosaic of smaller can be secured to the plate to replicate shower stall floors comprising tiles smaller than the tile size the cradle is configured to hold.

FIGS. 12-16 illustrate yet another embodiment of a linear drain cover assembly 326. The cylindrical portion 329 of this drain cover body 328 is substantially similar to that of the embodiment described above with reference to FIG. 6. However, instead of a flared portion, this drain includes a elongated trough 331. In addition to the drain body, this embodiment includes a drain cover 330, elongated mounting clips 334 and optionally trough extensions 332.

Figure 13:
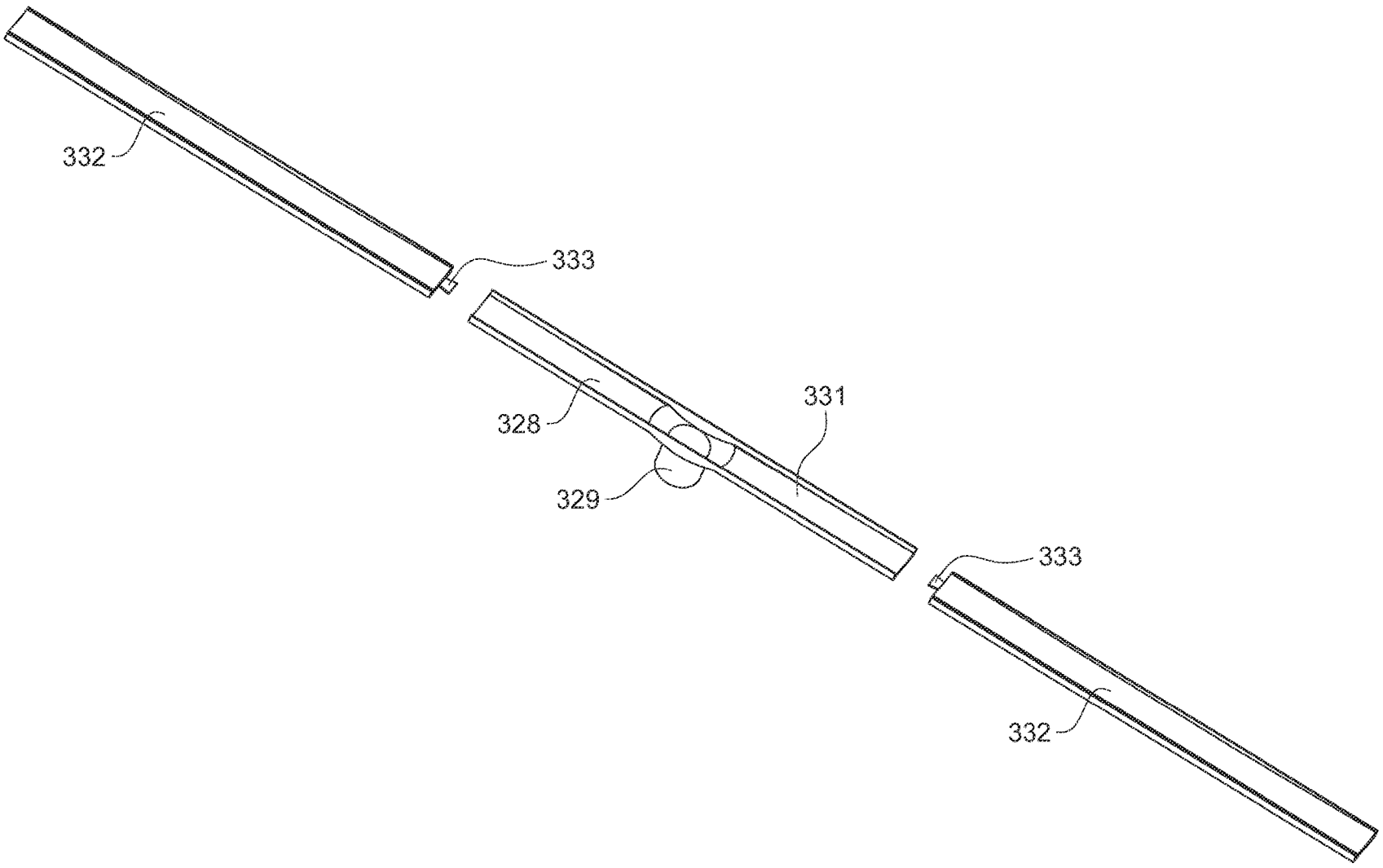
FIG. 13 is an isometric exploded top view of a drain cover body and left and right linear drain extensions of the drain cover assembly of FIG. 12 according to the embodiment of the present invention.
Figure 14:
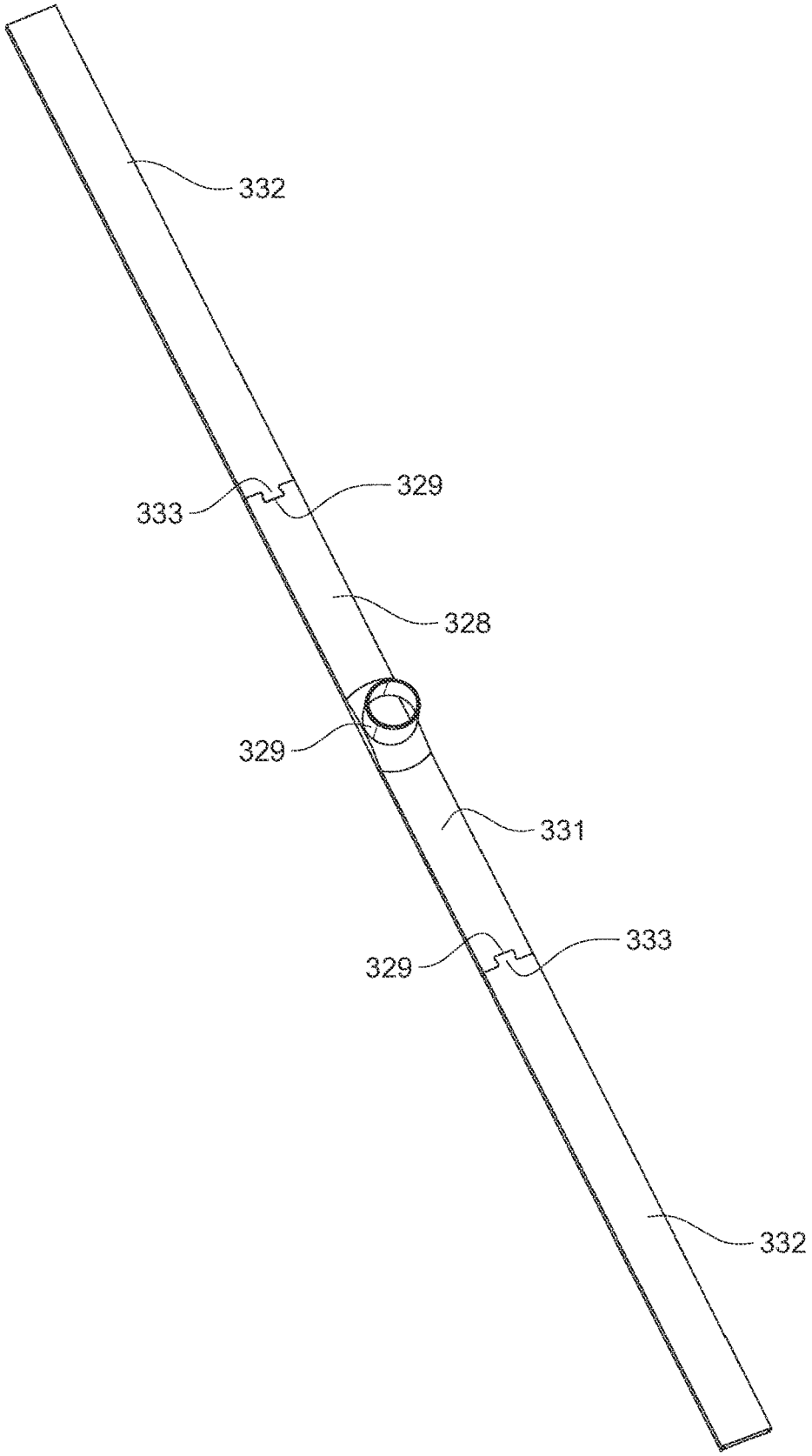
FIG. 14 is an isometric bottom view of the drain cover body and left and right linear drain extensions of the drain cover assembly of FIG. 12 according to the embodiment of the present invention.

The drain cover body 328 is best illustrated in FIGS. 13 & 14. It typically comprises an injection molded plastic although other suitable materials can be used in its construction. It comprises a cylindrical portion 329 similar to the cylindrical portion of the other drain cover bodies described herein. Attached to the open top end of the cylindrical portion is a linear elongated trough portion 331. The cylindrical portion is typically centered relative to the length of the trough portion although in variations the cylindrical portion can be offset to one side or the other.

The trough section 331 includes a trough floor that is gently sloped towards the top opening. The floor is also slight concave towards a longitudinal center axis of the floor. This can best be seen in the magnified view of the end of the drain cover assembly 326 shown in FIG. 12. Although the magnified view shows the end of a trough extension 332, it is appreciated the configuration shown is similar for the trough portion as well. On either side of the trough floor first and second longitudinal slots 327 are formed as can also be seen in FIG. 12. These slots are configured to receive both the mounting clips 334 and the drain cover 330. As best shown in FIG. 14, the left and right ends of the trough section on its bottom side include dovetail recesses 329 to receive the optional trough extensions.

Figure 12:
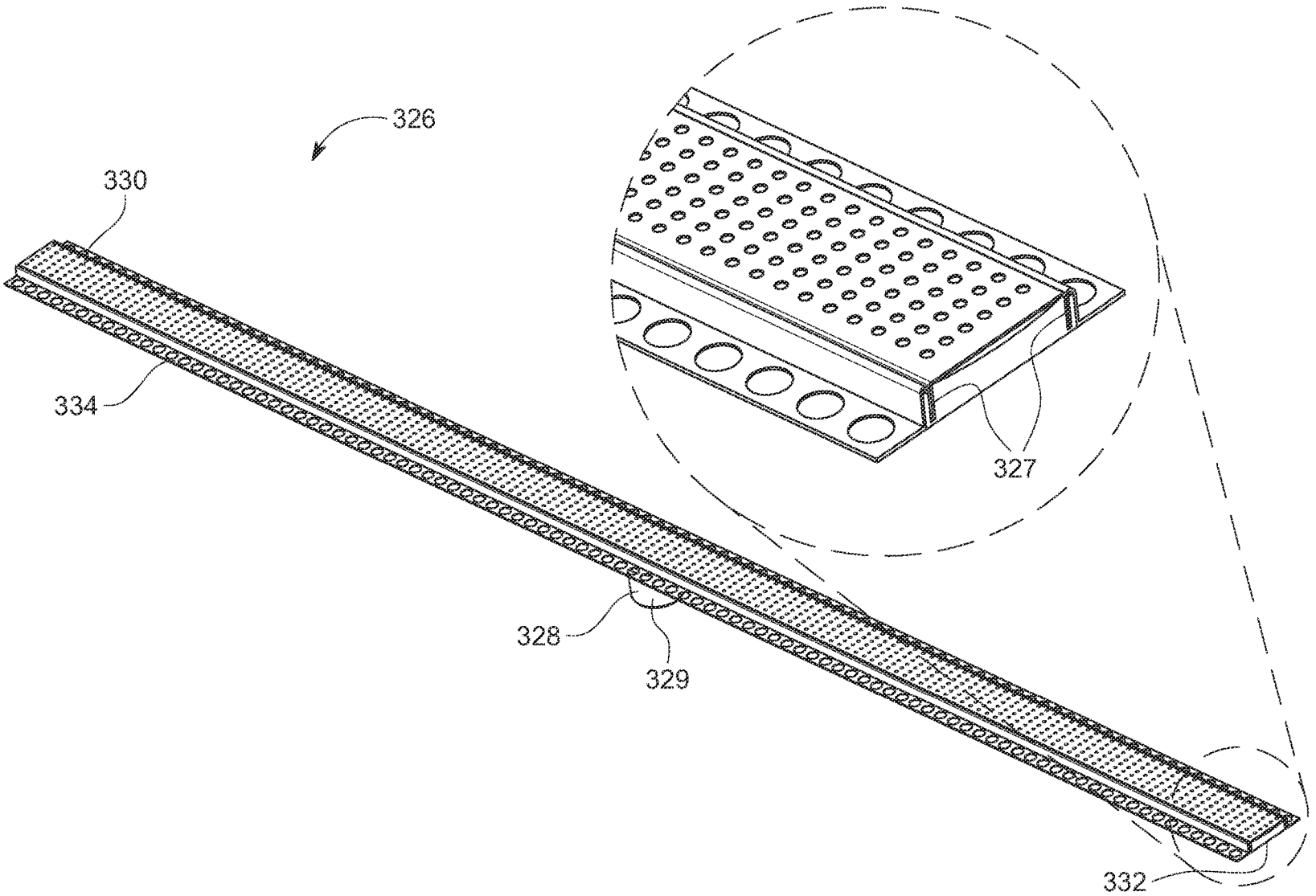
FIG. 12 is an isometric top view of a linearly extending drain cover assembly showing a magnified end portion according to an embodiment of the present invention.

The trough extensions 332 are also best shown in FIGS. 13 & 14 with an end of the section illustrated in the magnified view of FIG. 12. The trough extensions are attachable to the trough section of the drain cover body by way of dovetail protrusions 333 that are received in the respective dovetail recesses. The trough extensions are utilized when a longer linear drain is desired. As can be appreciated the length of the extensions can be trimmed so that the overall length of the linear drain cover assembly fits within a particular shower stall installation. Like the drain cover body, the trough extensions are typically comprised of a molded plastic.

Figure 15:
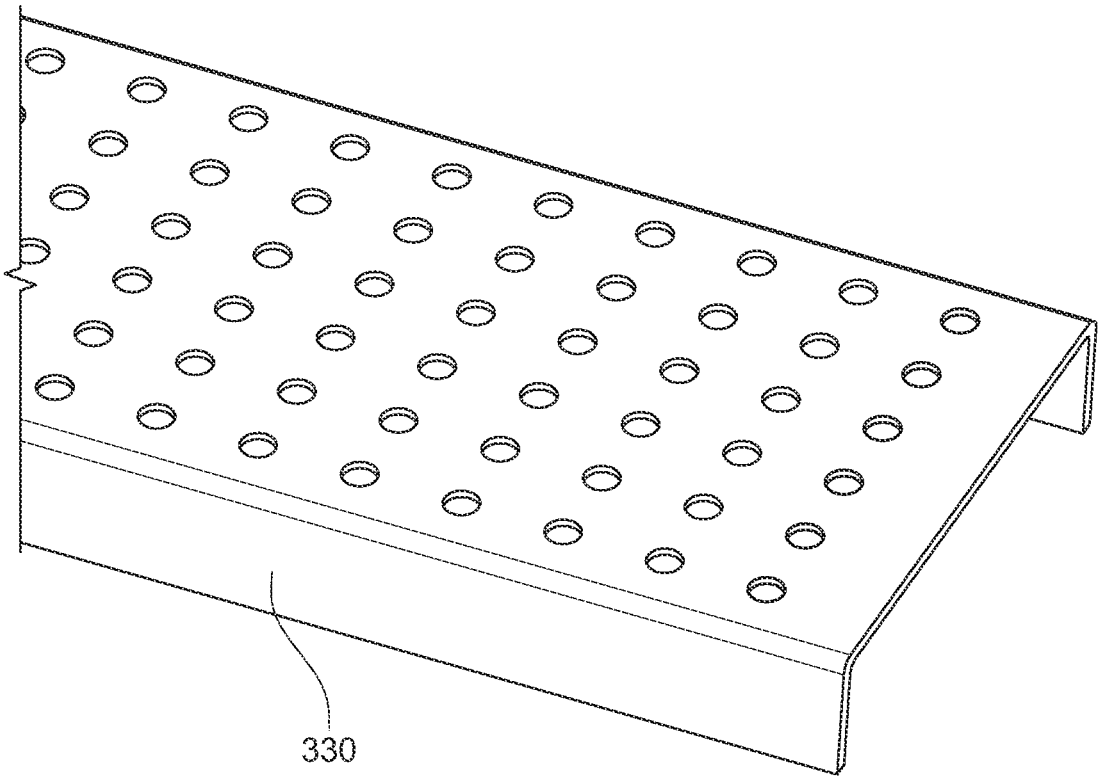
FIG. 15 is a partial isometric side of a drain cover of the drain cover assembly of FIG. 12 according to the embodiment of the present invention.

The drain cover 330 is typically comprised of stainless steel, although other materials can be used, and comprises a generally flat top with a plurality of drain openings distributed thereon in a desired pattern. A section of a drain cover is shown in FIG. 15. Longitudinal first and second legs extending downwardly from each longitudinal side of the cover and are configured to be received in the respective first and second longitudinal slots 327. The length of the cover can be trimmed as necessary to conform to the length of the associated drain body and applicable trough extensions.

Figure 16:
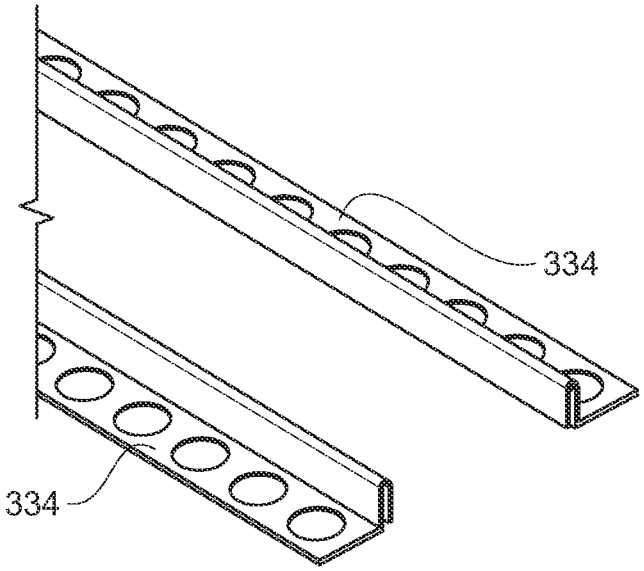
FIG. 16 is a partial isometric side of securing clips of the drain cover assembly of FIG. 12 according to the embodiment of the present invention.

The first and second securing clips 334 are used to help in fixedly securing the drain cover to the shower stall floor underneath the edges of abutting finish tiles. A section of a first and second clips are shown in FIG. 16. The clips are configured to slide over exterior lips of the trough portion and the trough extensions and into the first and second slots 327 as best shown in the magnified view of FIG. 12. The clips each include a flat horizontal portion that has a row of holes distributed thereon. The holes are configured to receive tile mortar therein to help secure the clip, the drain cover assembly 326 and the overlapping tile to the underlying shower pan floor.

A Method of Using

Embodiments of the point drain 10 can be used with any suitable custom shower pan system including dry set pans and pans fabricated using pre-sloped boards that cut and fitted within a shower stall to slope towards the drain. Typically, although not necessarily, the point drain assembly is installed in the shower stall subfloor by connecting the tubular section to an underlying drain pipe and mechanically fastening the clamping collar with fasteners to the subfloor. The waterproof membrane 12 is typically folded up on to itself and over the clamping collar 16 to be out of the way while the shower pan is fabricated and installed.

The shower pan is then installed over the subfloor so that it slopes towards the point drain or the linear drain cover assembly 326 when it is chosen. In at least one method, sloped waterproof boards are used, which are cut and placed on the subfloor so that they all slope towards the drain outlet. Of significance the thickness of the clamping collar is typically as thick as the thinnest portion of the shower pan such that the top surface of the collar is essentially even in height with the adjacent top of the backer board. In some pan installations, a layer of waterproof membrane will be bonded to the top of the pan for further waterproofing. In other installations, the pan itself will be sufficiently waterproof. Once the pan has been installed and waterproofed as necessary, the waterproof membrane 12 of the point drain 10 can be unfolded and adhesively secured to the adjacent portions of the pan. Next, finish flooring is installed in the shower stall. This typically comprises tile or natural stone but other finish flooring can be installed as well. The drain cover assembly can be placed into the throat of the drain body or it can be installed contemporaneously with the tiles surrounding the drain. Typically, the cover assembly is positioned slightly above its final installation height and once the cement and neighboring tiles are positioned in place, the installer can gently tap the drain cover using a mallet until its top surface is level or slightly lower than the top surfaces of the surrounding tile. Once the supporting cement placed underneath the cover assembly has hardened, the cover assembly will longer be adjustable and will be permanently secured in place.

Variations and Other Embodiments

The various embodiments and variations thereof, illustrated in the accompanying Figures and/or described above, are merely exemplary and are not meant to limit the scope of the invention. It is to be appreciated that numerous other variations of the invention have been contemplated, as would be obvious to one of ordinary skill in the art, given the benefit of this disclosure. All variations of the invention that read upon appended claims are intended and contemplated to be within the scope of the invention.

I claim:

1. A point drain comprising:

a drain body, the drain body having (i) a tubular section with a cylindrical interior wall and defining an interior, and a rotational axis, and (ii) a flange section integral with and extending radially outwardly from a top end of the tubular section;

a clamping collar having a substantially flat collar bottom side, and a substantially flat collar upper side with an open collar center wherein the tubular section extends through the open collar center and the drain body is fixedly secured to the clamping collar; and a flexible waterproof membrane having an open membrane center and extending outwardly therefrom, the membrane proximate the open membrane center being sealably sandwiched between the flat collar upper side and the bottom side of exterior portion of the flange section.

2. The point drain of claim 1, wherein the clamping collar is rectangular.

3. The point drain of claim 1, wherein the clamping collar includes two or more fastener holes.

4. The point drain of claim 1, wherein the drain body further comprises a plurality of fins generally parallel with the rotational axis and being spaced about the cylindrical interior wall, each fin of the plurality of fins extending inwardly from a line of intersection with the cylindrical interior wall.

5. The point drain of claim 1, further including a drain cover assembly, the drain cover assembly comprising (i) a drain cover body having a cylindrical portion defining an outside surface and a tubular passage with an open top end and an open bottom end, and (ii) a cover member attached to and at least partially covering the open top end, wherein the cylindrical portion is configured for receipt into the tubular section.

6. The point drain of claim 4 further comprising a drain cover assembly, the drain cover assembly comprising (a) a drain cover body having a cylindrical portion defining an outside surface and a tubular passage with an open top end and an open bottom end, and (b) a cover member attached to and at least partially covering the open top end, wherein the cylindrical portion is configured for receipt into the tubular section with interior edges of the plurality of fins incident against outside surface to hold the drain cover body in place within the tubular section.

7. The point drain of claim 4, wherein each fin of the plurality of fins extends inwardly at an acute angle relative to a plane defined by the rotational axis and the line of intersection.

8. The point drain of claim 4, wherein the acute angle for each fin of the plurality of fins is 30-60 degrees.

9. The point drain of claim 1, wherein an interior portion of the flange section slopes downwardly to the top end and an intersection with the interior, and an exterior portion with a substantially flat bottom side.

10. The point drain of claim 9, wherein the interior portion includes a plurality of weep channels formed therein extending radially towards the intersection with the interior.

11. The point drain of claim 5, wherein the cover member comprises a ceramic tile and the drain cover body further includes a tile cradle portion extending from and above the open end, the tile cradle portion being configured to removably receive and hold the ceramic tile therein.

12. The point drain of claim 5, further including a drain cover body, the drain cover body comprising (i) a cylindrical portion defining an outside surface and a tubular passage with an open top end and an open bottom end, and (ii) a tile cradle portion extending from and above the open end, the tile cradle portion being configured to removably receive and hold a solid rectangular tile therein, wherein the cylindrical portion is configured for receipt into the tubular section with interior edges of the plurality of fins incident against outside surface to hold the drain body in place within the tubular section.

13. The point drain of claim 12, further including the solid rectangular tile.

14. The point drain of claim 1, further including a drain cover assembly, the drain cover assembly comprising:

a drain cover body having (i) a cylindrical portion defining an outside surface and a tubular passage with an open top end and an open bottom end, (ii) an elongated trough portion, the trough portion extending from and above the open end, the trough portion having a length at least four times a width; and a drain body cover substantially covering the trough along the length and including drainage openings distributed thereon;

wherein the cylindrical portion is configured for receipt into the tubular section.

15. The point drain of claim 14, further comprising at least one trough extension, the trough extension including an extension end attachable to a trough end of the elongated trough portion.

16. The point drain of claim 14, wherein the trough includes a bottom surface and the bottom surface of the trough slopes downwardly towards the open top end.

17. A point drain comprising:

a drain body, the drain body having (i) a tubular section with a cylindrical interior wall and defining an interior, and a rotational axis, and (ii) a flange section integral with and extending radially outwardly from a top end of the tubular section;

a clamping collar having a substantially flat collar bottom side, and a substantially flat collar upper side with an open collar center wherein the tubular section extends through the open collar center and the drain body is fixedly secured to the clamping collar, the clamping collar including two or more fastener holes;

a flexible waterproof membrane having an open membrane center and extending outwardly therefrom, the membrane proximate the open membrane center being sealably sandwiched between the flat collar upper side and the bottom side of exterior portion of the flange section; and a drain cover assembly, the drain cover assembly comprising (i) a drain cover body having a cylindrical portion defining an outside surface and a tubular passage with an open top end and an open bottom end, and (ii) a cover member attached to and at least partially covering the open top end, wherein the cylindrical portion is configured for receipt into the tubular section.

* * * * *